United States Patent [19]

Podd

[11] Patent Number: 4,884,722

[45] **Date of Patent: * Dec. 5, 1989**

[54] BULKHEAD AND LINING SYSTEMS FOR CARGO CONTAINERS

[76] Inventor: Victor T. Podd, 255 Beverly Avenue, Montreal, Quebec, Canada

[ * ] Notice: The portion of the term of this patent subsequent to Jan. 24, 2006 has been disclaimed.

[21] Appl. No.: 249,893

[22] Filed: Sep. 27, 1988

Related U.S. Application Data

[63] Continuation of Ser. No. 920,030, Oct. 16, 1986, Pat. No. 4,799,607.

[51] Int. Cl.[4] ..... B67D 3/00

[52] U.S. Cl. ..... 222/535; 222/564; 422/40; 105/279

[58] Field of Search ..... 222/94, 105, 180, 564, 222/533, 535; 220/403, 404, 461; 383/45; 422/40; 105/239, 261.2, 270, 279

[56] References Cited

U.S. PATENT DOCUMENTS

| | | |
|---|---|---|
| 1,815,653 | 7/1931 | Jones . |
| 2,144,181 | 1/1939 | Hopper . |
| 2,708,542 | 5/1955 | Gray et al. . |
| 3,384,106 | 5/1968 | Isbrandtsen . |
| 3,756,469 | 9/1973 | Clark et al. . |
| 3,951,284 | 4/1976 | Fell et al. . |
| 4,054,226 | 10/1977 | Bjelland et al. . |
| 4,186,845 | 2/1980 | Podd . |
| 4,799,607 | 1/1989 | Podd ..... 222/105 X |

FOREIGN PATENT DOCUMENTS

| | | |
|---|---|---|
| 1205106 | 5/1986 | Canada . |
| 533317 | 8/1931 | Fed. Rep. of Germany . |

*Primary Examiner*—Joseph J. Rolla
*Assistant Examiner*—Gregory L. Huson
*Attorney, Agent, or Firm*—Scully, Scott, Murphy & Presser

[57] ABSTRACT

A bulkhead for use with a cargo container, and comprising a wall member and at least a first slanted corner member. The wall member holds a cargo in the container, and the corner member is connected to the wall member adjacent a lower corner thereof to guide cargo downwardly and laterally toward an outlet in the wall member. Also disclosed is a lining system for a cargo container, and comprising a flexible liner and a bulkhead to hold the liner in place in the container. The liner includes an inlet and an outlet, and collapsible inlet and outlet chutes are provided to selectively open and close the inlet and outlet of the liner. With one embodiment the lining system is air and water tight; and with an alternate embodiment, the liner allows gases to pass outward through the liner.

15 Claims, 8 Drawing Sheets

BULKHEAD AND LINING SYSTEMS FOR CARGO CONTAINERS

This is a continuation of copending application Ser. No. 920,030, filed on Oct. 16, 1986, now U.S. Pat. No. 4,799,607.

BACKGROUND OF THE INVENTION

This invention generally relates to loading, unloading and transporting bulk commodities in cargo containers; and more particularly, to bulkheads for such containers and to methods, and to lining systems especially well-suited for use in those methods, to help control the atmospheres in cargo containers.

Bulk cargo, such as grain, may be loaded into large containers and then transported in those containers from one location to another by ship, truck, or railroad, or some combination thereof; and once the containers reach a final destination, various techniques may be employed to unload the cargo from the containers. For instance, a low pressure, or suction, line may be connected to an opening in the back of a container to draw the cargo out of the container, or the container may be tilted so that gravity forces the cargo through the back of the container. While these unloading processes generally operate relatively effectively, it is believed that they may be improved upon in several respects.

For example, with these unloading procedures, the bulk cargo generally is forced backwards, toward the rear of the container, but is not directed in any significant way specifically toward the outlet in the back of the container; and the unloading process would be more efficient if the cargo was specifically directed, as it moves rearward through the container, toward the back outlet thereof. Also, as the cargo is unloaded, an appreciable amount of the cargo may collect in the lower left and lower right hand corners of the back of the container, and often it is necessary to have a worker make a special effort to remove the portion of the cargo that collects in these corners. This is expensive and time consuming, and hence the unloading process could be improved by reducing the amount of cargo that collects in those back corners of the container.

In addition to the foregoing, many bulk commodities such as coffee and cocoa beans, rice and sugar, are shipped over very large distances from regions of the world where the commodities are grown to regions where they are processed or consumed. Typically the environment in which the commodities are located while being shipped is not closely controlled, and the shipments may be subjected to wide changes in temperature and humidity. Further, the shipments normally are not well ventilated and often gases which are produced by the commodities, will accumulate in the cargo containers.

For example, as a cargo container is shipped from a tropical climate to a temperate zone, the temperature of the container may drop over 100° F., and this may cause moisture to condense in the container. This moisture, in turn, may be absorbed by the goods in the container and cause fungus and bacteria to grow in those goods. Further, several agricultural products, such as coffee and cocoa beans, ferment as they are transported and produce gases in the cargo container. Normally, the air in which the commodities are stored is not well ventilated, and gases produced by the commodities accumulate in the air in which the goods are held. If this happens, moisture in the gases may condense and be absorbed by the goods, causing fungus and bacteria to grow in those commodities.

SUMMARY OF THE INVENTION

An object of the present invention is to facilitate discharging bulk cargo from a container.

Another object of this invention is to provide a bulkhead for a cargo container with a corner member to direct bulk cargo in the container toward a discharge opening in the bulkhead, and to inhibit the cargo from collecting in a lower rear corner of the container.

A further object of this invention is to control the atmosphere in which a bulk commodity is transported.

Another object of the present invention is to withdraw air from a cargo container liner to develop a space between the liner and the top of a cargo container to inhibit the transfer of moisture from the container top to the cargo in the container.

A further object of this invention is to use a liner having at least a part that is gas permeable to vent gas at a controlled rate from a bulk commodity inside the liner.

In accordance with a first aspect of this invention, a bulkhead is provided for use with a cargo container, and the bulkhead comprises a wall member and a corner member. The wall member is provided to hold the cargo in the container, and this member includes an outlet opening to discharge the cargo from the container. The corner member is connected to the wall member adjacent a lower corner thereof, and the corner member slants forwardly downwardly and laterally downwardly toward the outlet in the wall member to guide cargo toward that outlet opening.

With a particularly preferred embodiment, the bulkhead is provided with both left and right corner members respectively connected to the wall member adjacent lower left and right corners thereof. Each of these corner members is pivotally connected to the wall member for movement between a closed position, wherein the corner member is closely adjacent and substantially parallel to the wall member, and an open position wherein the corner member slants forwardly downwardly and laterally downwardly toward the outlet opening in the wall member to guide cargo downward toward that outlet. Means may be provided to pull these corner members to their open positions from their closed positions, and the wall member may include openings to provide access to the pulling means from a back side of the wall member.

In accordance with a second aspect of the invention, methods, and lining systems especially well suited for use in those methods, are provided to help control the atmospheres in cargo containers. The lining system includes a flexible liner adapted to be inserted into a container, and a bulkhead to hold the liner in place therein. The liner defines an interior to receive and hold a bulk cargo, an inlet in communication with the interior to conduct cargo thereinto, and an outlet also in communication with the liner interior to conduct cargo out of the liner. The bulkhead includes a cargo inlet located adjacent the liner inlet, and a cargo outlet located adjacent the liner outlet.

One embodiment of the lining system is air and water tight and may be used either to keep gases and water out of the lining system, or to keep particular gases inside the liner. Another embodiment of the lining system is gas permeable to vent from the lining system gases produced by a bulk commodity stored therein. With either embodiment, the liner of the lining system may be collapsed onto a commodity therein to develop a space between the top of the liner and the top of the cargo container in which the liner is located, and this space may be used to thermally insulate the commodity from the container top.

Further benefits and advantages of the invention will become apparent from a consideration of the following detailed description given with reference to the accompanying drawings, which specify and show preferred embodiments of the invention.

DETAILED DESCRIPTION OF THE PREFERRED EMBODIMENTS

Figure 2:
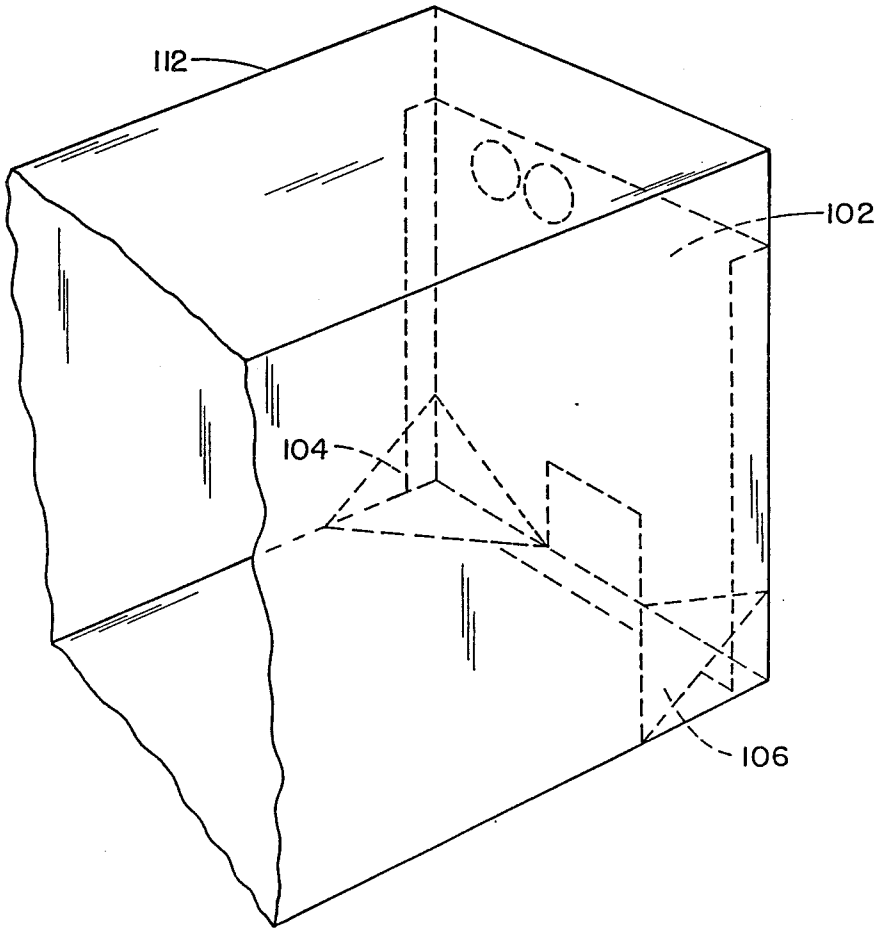
FIG. 2 is a perspective view of part of a cargo container, with the bulkhead of FIG. 1 located in the container and shown in broken lines.
Figure 1:
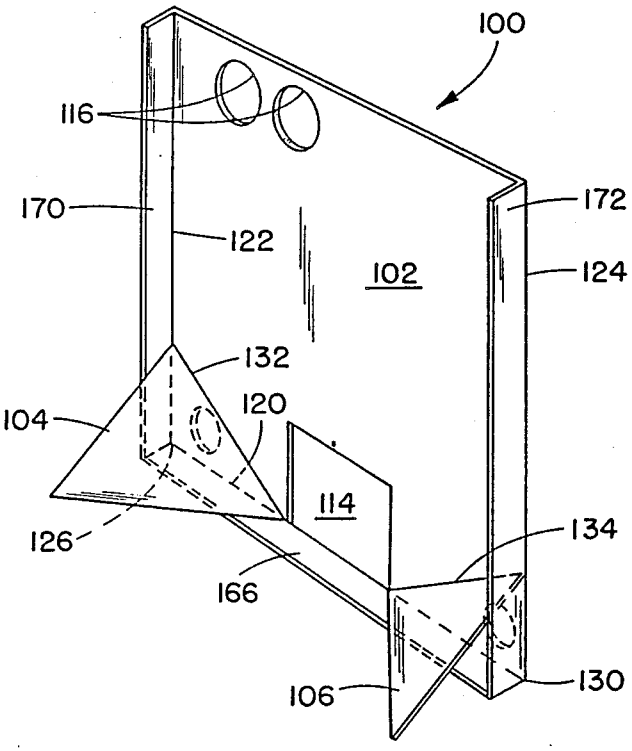
FIG. 1 is a front perspective view of a bulkhead in accordance with the present invention.

FIG. 1 illustrates bulkhead 100 generally comprising wall member 102 and left and right corner members 104 and 106. With reference to FIG. 2, bulk head 100 is used to form a moveable, temporary wall in a cargo container 112 to hold a supply of a bulk cargo (not shown) therein, and thus wall member 102 is dimensioned to laterally extend substantially completely across the interior of the container, in a relatively close fit with the side walls thereof. Also, the height of wall member 102 is such that, in use, the wall member extends for a substantial portion of the height of the inside of cargo container 112, although preferably the top of the wall member is kept 12 to 18 inches short of the top of the cargo container.

Wall member 102 includes at least one opening to conduct material into and to discharge material from container, and the wall member may be provided with a plurality of openings for these purposes. With the embodiment of bulkhead 100 shown in FIGS. 1 and 2, wall member 102 has a lower opening 114, which is used to discharge cargo from container 112, and a pair of upper openings 116, which are used when cargo is loaded into the container. In particular, a commodity may be fed under pneumatic pressure into container 112, through one of the openings 116, while air is vented from inside the container through the other opening 116, maintaining the air pressure in the container at about atmospheric pressure.

Wall member 102 includes bottom edge 120 and left and right side edges 122 and 124; and the bottom edge and the left edge form a lower left corner 126, and the bottom edge and the right edge form a lower right corner 130. As shown in FIGS. 1 and 2, discharge opening 114 has a generally rectangular or square shape, is centrally located along bottom edge 120 of wall member 102 and extends upward therefrom, although the discharge opening may be located at other areas of the wall member without departing from the scope of this invention.

Left corner member 104 is connected to wall member 102 adjacent lower left corner 126, and the left corner member slants outwardly downwardly away from the wall member and rightwardly downwardly toward outlet opening 114. Similarly, right corner member 106 is connected to wall member 102, adjacent lower right corner 130, and this corner member slants outwardly downwardly and leftwardly downwardly toward outlet opening 114. In this way, as a bulk cargo moves rearward through cargo container 112 and toward outlet opening 114, corner members 104 and 106 guide the cargo downward and toward that outlet opening.

Figure 3:
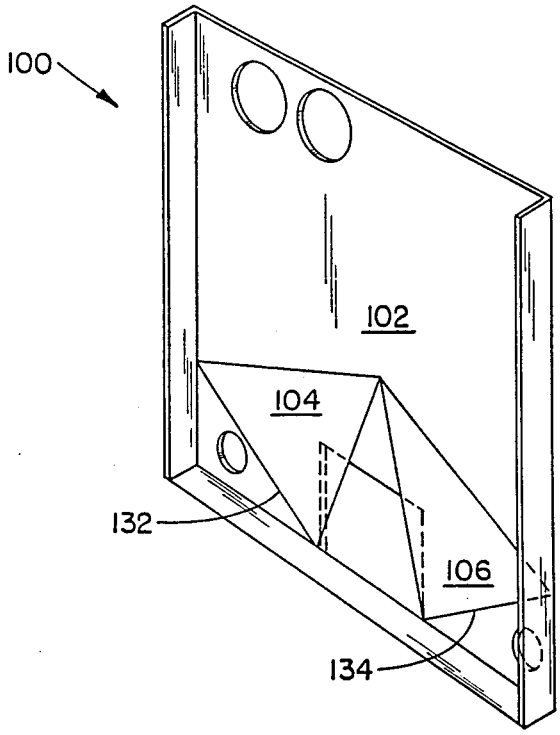
FIG. 3 is a front perspective view of the bulkhead in a closed position.

Corner members 104 and 106 are preferably connected to wall member 102 for movement between the positions shown in FIGS. 1 and 2, referred to as the open positions, and closed positions, shown in FIG. 3, wherein the corner members are closely adjacent and substantially parallel to the wall member. When corner members 104 and 106 are in their closed positions, wall member 102 and the corner members form a very compact unit, and this facilitates storing and shipping bulkhead 100. Preferably, left corner member 104 is connected to wall member 102 for pivotal movement about a left connecting line 132, between the open and closed positions of the left corner member; and right corner member 106 is connected to wall member 102 for pivotal movement about a right connecting line 134, between the open and closed positions of the right corner member.

Preferably, each of the corner members 104 and 106 has a triangular shape, including first, second and third edges, and the first edge of each corner member 104 and 106 is connected to wall member 102 along one of the connecting lines 132 and 134. When left corner member 104 is in the open position, as shown in FIG. 1, a second edge of the corner member extends forwardly downwardly from wall member 102, generally coplanar with left side edge 122 of the wall member, and a third edge of the corner member extends forwardly to the left, generally coplanar with the bottom edge 120 of the wall member. Analogously, when right corner member 106 is in its open position, a second edge of the corner member extends forwardly downwardly from wall member 102, generally coplanar with right side edge 124 of the wall member, and a third edge of the corner member extends forwardly to the right, generally coplanar with bottom edge 120 of the wall member.

Figure 4:
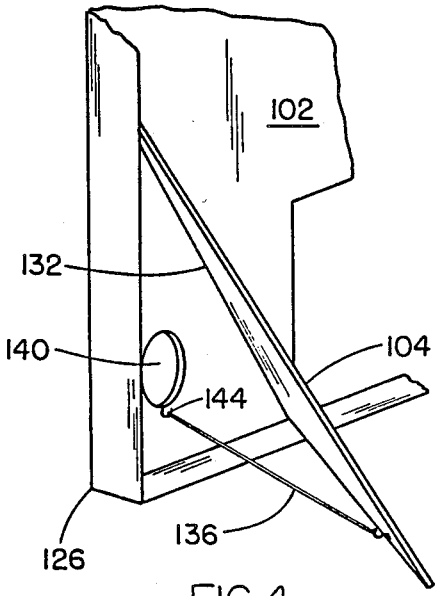
FIGS. 4 and 5 are side, perspective views of left and right lower corners, respectively, of the bulkhead.
Figure 5:
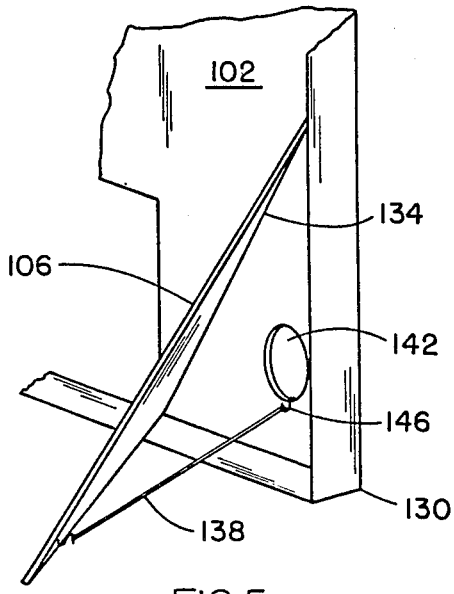

Bulkhead 100 may further comprise means to move left and right corner members 104 and 106 from their closed positions into their open positions, and preferably a separate means is connected to each corner member to move the corner member into its open position. Various means may be used to move corner members 104 and 106 into their open positions, and, for example as shown in FIGS. 4 and 5, first and second cords or straps 136 and 138 may be connected to the left and right corner members, respectively, to do this.

Corner members 104 and 106 are connected to a front side of wall member 102 that, in normal use, faces forward in cargo container 112, and preferably bulkhead 100 is also provided with left and right access openings 140 and 142 to provide access to cords or straps 136 and 138 from the backside of the wall member. Left access opening 140 is located between lower left corner 126 and left connecting line 132, and right access opening 142 is located between lower right corner 130 and right connecting line 134. With access openings 140 and 142, it is very easy for a worker to move corner members 104 and 106 into their open position even after bulkhead 100 is secured in place inside container 112.

With the arrangement where left and right corner members 104 and 106 are pivotally connected to wall member 102, there may be a tendency for the corner members to return toward their closed positions after being pulled to their open positions. For this reason, it is desirable to provide bulkhead 100 with means to further connect corner members 104 and 106 to wall member 102 to releasably hold the corner members in their open positions. For instance, again with reference to FIGS. 4 and 5, these means may comprise hooks 144 and 146 secured on ends of cords 136 and 138 respectively, and which, in use, are hooked onto edges of access openings 140 and 142. The lengths and elasticity of cords 136 and 138 are such that, when hooks 144 and 146 are hooked onto edges of access openings 140 and 142, the cords are held taught between wall member 102 and corner members 104 and 106, holding the corner members securely in their open positions.

Figure 6:
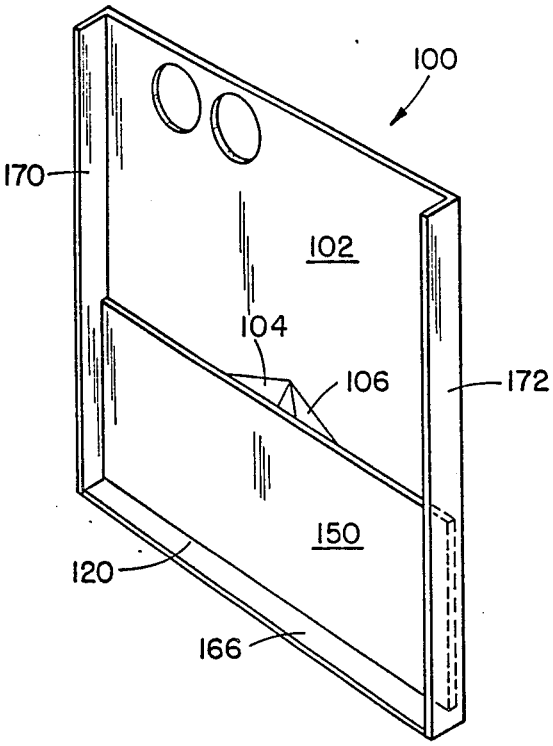
FIGS. 6 and 7 are front perspective views of the bulkhead, and showing a retaining panel that may be used therewith, with FIG. 6 showing the retaining panel in a closed position and FIG. 7 showing the retaining panel in an open position.
Figure 7:
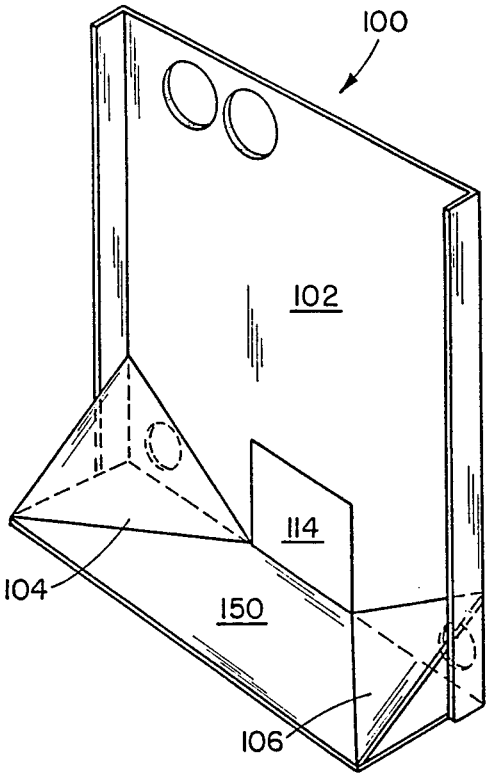

With reference to FIGS. 6 and 7, bulkhead 100 may be provided with retaining means 150 to help hold corner members 104 and 106 in their closed positions. More specifically, retaining means 150 is connected to wall member 102 for movement between a closed position, wherein the retaining means holds left and right corner members 104 and 106 in their closed positions, and an open position, wherein the retaining means allows the left and right corner members to move between their open and closed positions.

Preferably, retaining means 150 includes a flat panel pivotally connected to bottom edge 120 of wall member 102 for movement between the above-mentioned open and closed positions. In the closed position (shown in FIG. 6), retaining means 150 extends upward from bottom edge 120 of wall member 102, substantially parallel to the wall member, and the retaining means holds, and substantially covers, left and right corner members 104 and 106 in their closed positions. In its open position (shown in FIG. 7), retaining means 150 extends forward from bottom edge 120 of wall member 102 and allows left and right corner members 104 and 106 to move between their open and closed positions. As shown in FIGS. 6 and 7, retaining panel 150 has a generally rectangular shape, with the length of the retaining panel being substantially equal to the width of wall member 102. One longitudinal edge of retaining panel 150 is connected to bottom edge 120 of wall member 102, and transverse edges of the retaining panel are generally coplanar with left and right edges 122 and 124 of the wall member.

Figure 8:
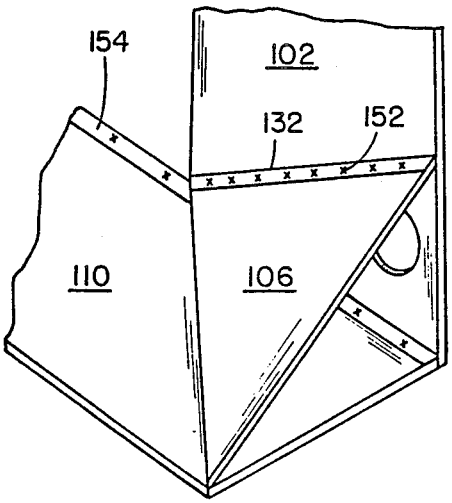
FIG. 8 is a perspective view of the lower right portion of the bulkhead.

Wall member 102, corner members 104 and 106, and retaining member 150 may be made of any suitable material such as wood or metal, and preferably these members are made from corrugated cardboard. Also, corner members 104 and 106 and, if used, retaining member 150 may be connected to wall member 102 in any acceptable way; and, for example, staples, adhesive or a combination of both, or strips of cloth or nylon may be used to connect these parts together. To elaborate, as shown in FIG. 8, a first strip 152 of material may be connected to wall member 102 along connecting line 134 and to corner member 106 along a first edge thereof to connect those members together for pivotal movement about the right connecting line. A second strip (not shown) may be similarly connected to wall member 102 along connecting line 132, and to corner member 104 along a first edge thereof to connect those members together for pivotal movement about the left connecting line. A third strip 154 may be connected to wall member 102 along bottom edge 120 and to a portion of retaining member 150 along an edge thereof to connect the wall member and the retaining member together for pivotal movement about the bottom edge of the wall member.

Figure 9:
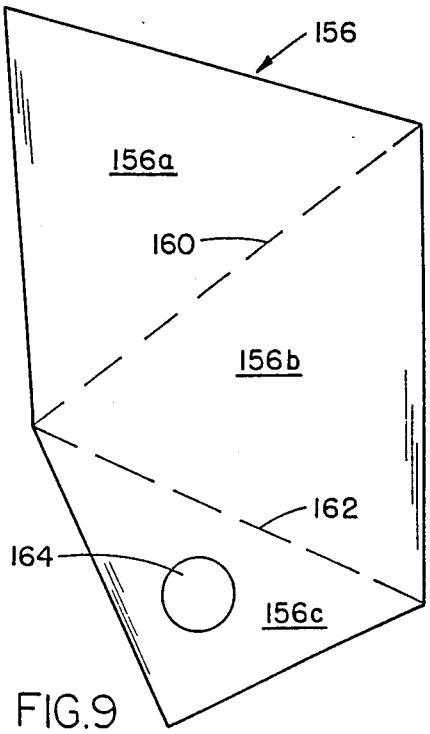
FIG. 9 is a plan view of a preform from which a member of the bulkhead may be made.

Preferably, with reference to FIG. 9, corner members 104 and 106 are each formed from a different preform 156. Pre-form 156 includes a plurality of fold lines 160 and 162, separating the pre-form into sections 156*a*, *b* and *c*. Section 156*a* is folded over line 160 and then connected to section 156*b*, for example, by staples or an adhesive, to form a corner member having a double, reinforced strength. The corner member is connected to wall member 102 by positioning section 156*c* parallel with and against the wall member, with fold line 162 aligned with connecting line 134 or 136, and then directly securing the section 156*c* to the wall member by, for example, staples, adhesives or a combination of both. If necessary, section 156*c* may be provided with its own access opening 164 that, in use, is aligned with access opening 140, 142 so that section 156*c* does not block the access openings in wall member 102.

A support frame, including bottom strip 156 and left and right edge strips 170 and 172 may be connected to wall member 102 to help hold the wall member in place in cargo container 112. Preferably, edge strips 170 and 172 are pivotally connected to wall member 102 for pivotal movement about left and right edges 122 and 124 of the wall member, and bottom strip 166 is pivotally connected to the wall member for pivotal movement about the bottom edge 120 of the wall member. Strips 166, 170 and 172 and wall member 102 may be formed from a single cardboard blank that is provided with the appropriate fold lines to allow the bottom and edge strips to be bent into the desired positions.

As shown in FIGS. 1–3, outlet opening 114 is centrally located in wall member 102, between side edges 122 and 124. Outlet opening 114 may be located in other areas of wall member 102 without departing from the scope of the present invention; and, indeed, the wall member may be provided with a plurality of outlet openings. Of course, when a cargo is being transported in container 112, outlet opening 114 as well as openings 116 are normally closed, and outlet 114 is opened to discharge the bulk cargo from the container. Depending on the specific location of the cargo discharge opening or openings in wall member 102, corner members 104 and 106 may be larger or smaller than as shown in FIGS. 1–3. Also, the left and right corner members of a particular bulkhead may have unequal sizes, unequal slopes, or both unequal sizes and slopes. In addition, the preferred slopes of the corner members may vary depending on the specific cargo with which a bulkhead is used.

It is not necessary to the present invention that bulkhead 100 be provided with two corner members, and instead the bulkhead may include a single corner member, either left corner member 104 or right corner member 106.

For example, some cargo containers include a discharge opening located on the left or right side of a back wall or door of the container. When the bulkhead of the present invention is used with such a container, it may be preferred, first, to form discharge outlet 114 toward a lateral edge of wall member 102 so that this discharge outlet of the bulk head can be aligned with the off-center outlet of the cargo container, and second, to provide bulkhead 100 with just a single corner member slanting forwardly downwardly and laterally downwardly toward the discharge opening of the bulkhead, to guide the cargo toward that discharge outlet as the container is unloaded.

The bulkhead of this invention can be used in intermodal ocean going containers, trailer trucks or other moveable containers. The bulkhead can also be used with non-moveable containers for the storage of commodities, and the bulkhead can be used with dry or liquid bulk commodities. Handles (not shown) may be connected to bulkhead 100 at any suitable location to help workers handle and move the bulkhead. Plastic or metal threaded or non-threaded fittings can be installed on bulkhead 100 around openings 114 and 116 to connect those openings to closure members or to conduits to conduct cargo through the openings. Such fittings may be especially appropriate if a completely closeable system is desired or if the cargo container is used to carry liquids.

Figure 10:
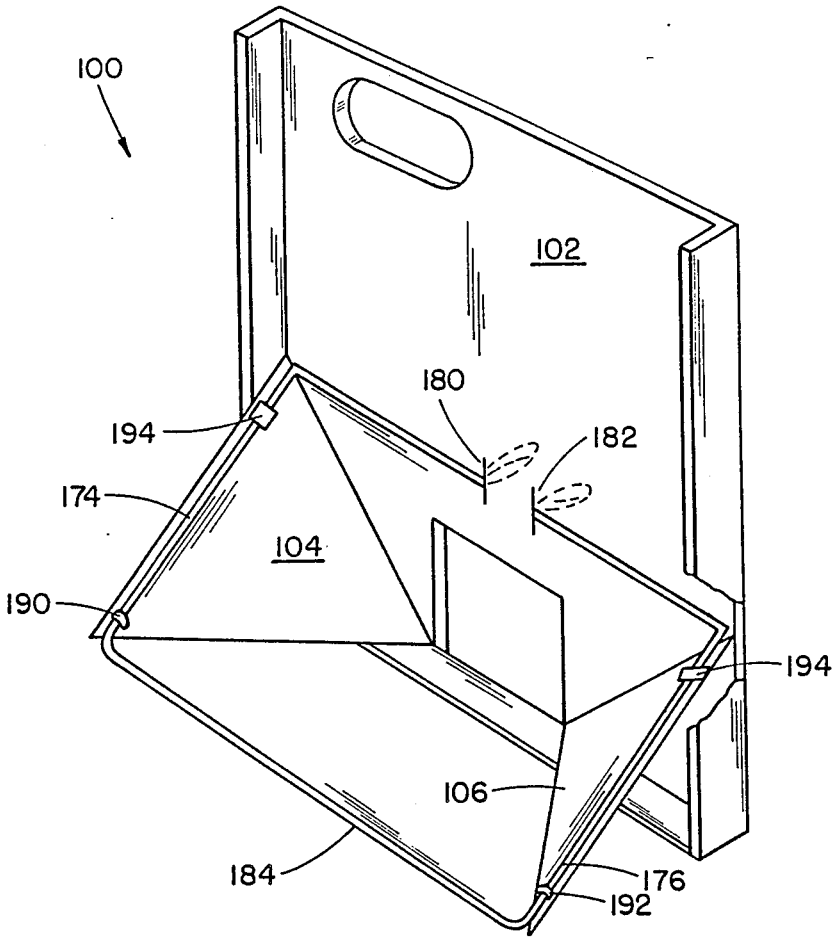
FIG. 10 is a front perspective view of the bulkhead, showing a strap that may be used to shake corner members of the bulkhead.

When a bulk cargo is discharged through outlet 114 of bulkhead 100, it is possible that a small portion of the cargo may collect on or adjacent corner members 104 and 106; and bulkhead 100 may further be provided with means connected to those corner members and extending through wall member 102, to the backside thereof, to shake the corner members to further assist the cargo through discharge outlet 114. As shown in FIG. 10, this means may comprise first and second strap portions 174 and 176. First strap portion 174 is connected to left corner member 104 and extends therefrom through a first slot 180 in wall member 102; and second strap portion 176 is connected to the right corner member 106 and extends therefrom through a second slot 182 in the wall member.

Preferably, first and second strap portions 174 and 176 are connected together via a front connecting portion 184 which extends between the corner members 104 and 106, so that the strap portions form a single or continuous strap. With this preferred arrangement, strap portions 174 and 176 are connected to corner members 104 and 106 via slip rings 190 and 192 and, more specifically, these rings are connected to lower front portions of corner members 104 and 106, respectively, and strap portions 174 and 176 extend through and are supported for sliding movement through the slip rings 190, 192.

In operation, after a bulk cargo has been substantially discharged through bulkhead 100, strap portions 174 and 176 may be pulled to shake corner members 104 and 106 up and down to help discharge any remaining cargo that may collect on or adjacent the corner members. Preferably, the ends of strap portions 174 and 176 rearward of wall member 102 are formed into loops to help a worker pull those strap portions, although other suitable handling means may be connected to these strap portion ends for this purpose. Also, it may be desirable to releasably connect strap portions 174 and 176 to corner members 104 and 106, for example by adhesive tape 194, as shown in FIG. 10, to hold the strap portions away from discharge outlet 114 and to prevent the strap portions from interfering with the normal discharge of cargo through the discharge outlet until it is desired to shake the corner members 104 and 106.

Figure 11:
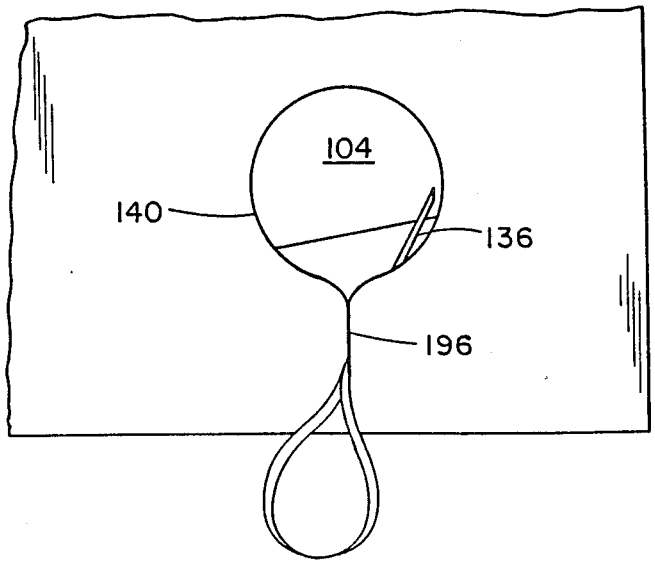
FIG. 11 is a back view of the lower left corner of the bulkhead.

To allow corner members 104 and 106 to move up and down as described above, it may be desirable to connect cords 136 and 138 to wall member 102 in the manner shown in FIG. 11, instead of as shown in FIGS. 4 and 5. As shown in FIG. 11, a slot 196 is formed in the wall member 102, extending outward from access opening 140, and cord 136 is pulled into this slot. Frictional forces between cord 136 and the surfaces forming slot 196 securely hold the cord in place, and thereby hold the corner member 104 in its open position, during normal use of bulkhead 100. However, the length and/or elasticity of cord 136 allows corner member 104 to move up when strap portion 174 is used to shake that corner member. The back end of cord 136 may be formed into a loop to help pull corner member 104 from its closed position to its open position when this is desired.

Figure 12:
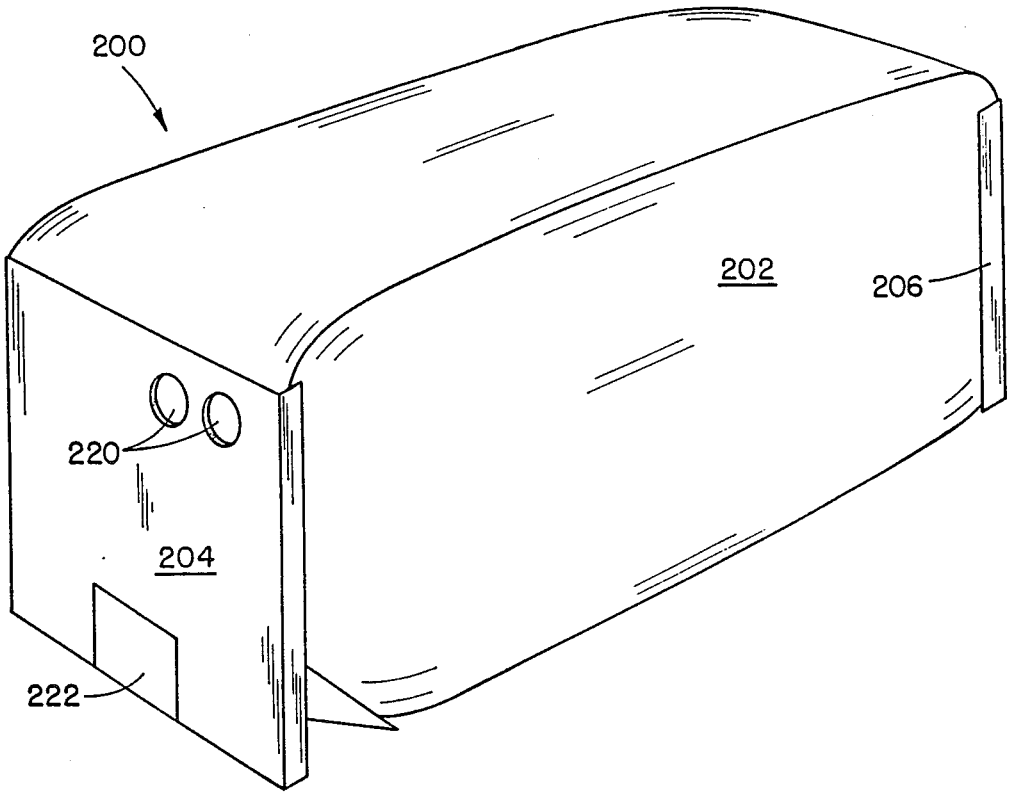
FIG. 12 is a back perspective view of a container lining system according to this invention.
Figure 13:
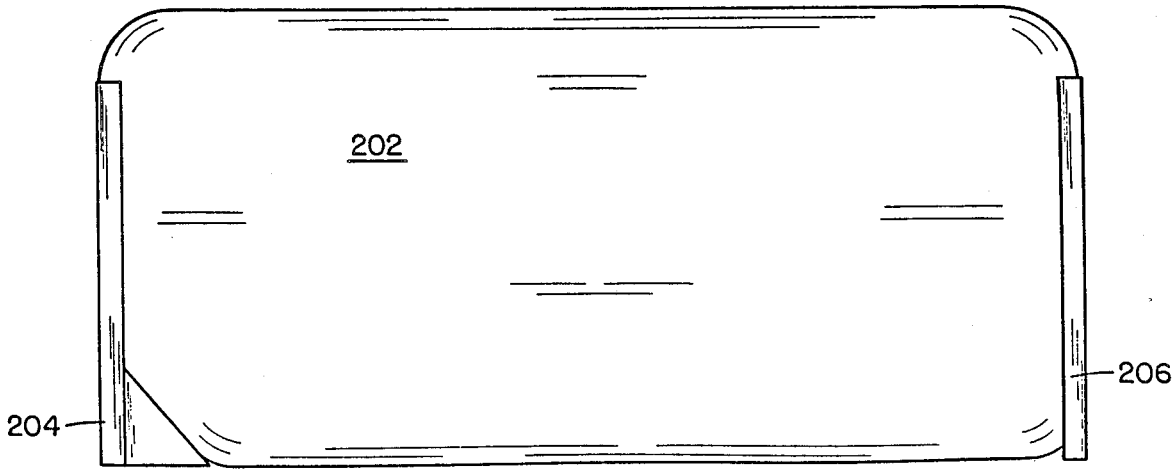
FIG. 13 is a side, elevational view of the lining system shown in FIG. 12.

FIGS. 12 and 13 show a lining system 200 in accordance with a second aspect of the present invention, and generally this lining system comprises a flexible liner 202 and rear bulkhead 204, and the system may also include a front bulkhead 206. Lining system 200 is adapted to be located inside a cargo container, with liner 202 normally in a relatively close fit with the walls and floor of the container, and the liner 202 defines an interior to receive and hold a bulk cargo. With respect to FIG. 14, liner 202 also defines one or more inlet openings 210 in communication with the interior of the liner to conduct cargo thereinto, and an outlet opening 212 also in communication with the liner interior to conduct cargo out of the liner. Liner 202 may be made of any suitable material, and for instance the liner may be made from an air and water tight fabric.

Figure 14:
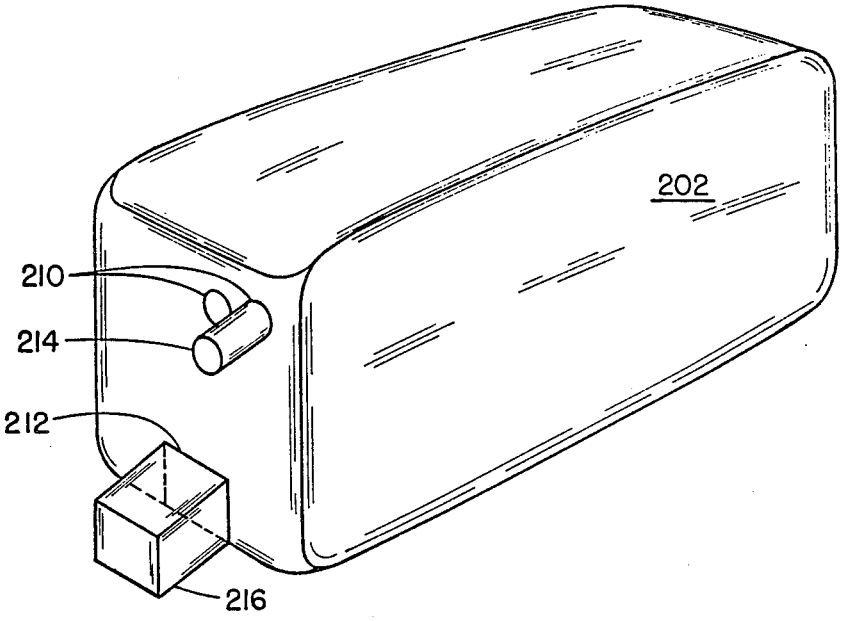
FIG. 14 is a back perspective view of a liner of the lining system of FIG. 12.

Preferably, collapsible inlet chute 214 is connected to liner 202 around an inlet 210; and this chute has an open position, shown in FIG. 14 wherein the chute forms a passageway in communication with liner inlet 210 to guide cargo thereinto, and a closed position wherein the inlet chute closes the inlet of the liner to prevent cargo from passing therethrough. Further, collapsible outlet chute 216 is preferably connected to liner 202 around outlet 212; and this chute has an open position, shown in FIG. 14, wherein the chute forms a passageway in communication with outlet 212 of liner 202 to guide cargo therefrom, and a closed position wherein the discharge chute covers the outlet of the liner to prevent the cargo from passing therethrough. Chutes 214 and 216 may be connected to liner 202 in any acceptable manner, such as by an adhesive, or the chutes and the liner may be heat sealed together.

Bulkhead 204 abuts against the back end of liner 202 to hold the liner in place in a cargo container; and, when used, front bulkhead 206 abuts against the front end of liner 202 to help hold the liner in a defined shape inside the cargo container. It is not necessary to connect liner 202 to either of bulkheads 204 or 206; although if this is done, the liner may be connected to the bulkheads in any suitable way, such as by an adhesive. The shapes of bulkheads 204 and 206 normally match the vertical cross-sectional shape of the container with which they are used, and typically the bulkheads have a generally rectangular or square shape. Preferably, bulkheads 204 and 206 are relatively firm and sturdy, and the bulkheads may be made of any suitable materials such as corrugated cardboard. The bulkhead 100 described above in connection with FIGS. 1–11 may be used in lining system 200, although other suitable bulkheads may also be used in these systems.

Rear bulkhead 204 includes inlet openings 220 and an outlet opening 222. Inlet openings 220 are located adjacent inlets 210 of liner 202 to conduct cargo through the bulkhead and into the inlet of the liner when inlet chute 214 is in its open position, and bulkhead outlet 222 is located adjacent liner outlet 212 to conduct the cargo through the bulkhead from the outlet of the liner when outlet chute 216 is in its open position. Preferably, when inlet chute 214 is in its open position, that chute is pulled through an inlet 220 of bulkhead 204; and similarly, when discharge chute 216 is in its open position, that chute is pulled through outlet 222 of the rear bulkhead. Front bulkhead 206 may also include one or more openings, although these openings are not shown in the drawings.

Lining assembly 200 is installed in a cargo container in any suitable way. For instance, if front bulkhead 206 is not used, liner 202 may be placed inside the cargo container, and a wooden strip (not shown) may be placed inside the liner and nailed over the bottom inside surface of the liner and into the floor of the cargo container. Then, the liner is partially inflated with a high volume, low pressure air to ensure that the liner fits into all the corners of the container. Once liner 202 is installed, rear bulkhead 204 can be installed and braced, for example, in a manner discussed below. Unloading chute 216 is pulled through bulkhead discharge opening 222 to insure proper alignment of liner 202 and then the outlet chute 216 is tied closed. The tied outlet chute 216 is rolled within discharge outlet 222 and then that outlet may be covered, for instance, as discussed below.

Once lining system 200 is properly positioned and secured in the container, a bulk commodity is loaded thereinto, and this may also be done in any suitable way. For example, with reference to FIGS. 12 and 14, a tube may be inserted into inlet chute 214 and connected to this chute or to liner 202 to feed the commodity, under pneumatic pressure, through inlet chute 214, bulkhead inlet 220 and liner inlet 210 and into the interior of the liner 202. Preferably, liner 202 is kept fully inflated during this loading process.

Figure 15:
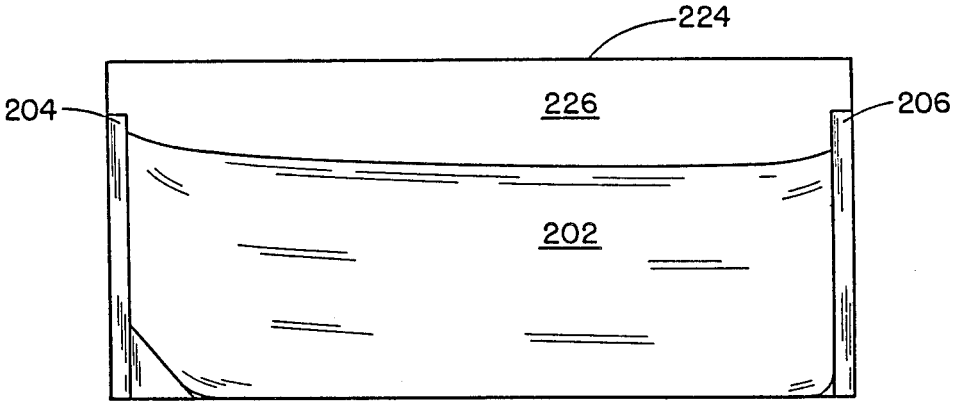
FIG. 15 is a side view of the lining system, located inside a container and with the liner collapsed on a commodity located therein.

Lining system 200 may be used in several ways. With one embodiment of system 200, liner 202 and chutes 214 and 216 are made of air and water-tight materials, so that the lining system may be made essentially air and water-tight by tightly closing chutes 214 and 216, and this lining system may be used either to keep gases and water out of the liner, or to keep particular gases inside the liner. For example, with reference to FIGS. 12, 14 and 15, after lining system 200 is installed within container 224 and after a commodity has been loaded into liner 202, but before chute 214 is closed, a low pressure line may be connected to liner inlet 210 to draw air out of the liner. Among other things, this reduces the amount of moisture inside liner 202, and this reduces the rate at which any moisture might condense inside the liner. Also, as air is drawn out of liner 202, the liner collapses onto the commodity inside the liner, and a space 226 develops between the top of the liner and the top of container 224. This space 226 acts as a vapor barrier and inhibits the movement of moisture, which may condense on the inside surface of the top of cargo container 224, into the liner 202. This space 226 also acts as thermal insulation between liner 202 and container 224 and thus has a moderating influence on temperature changes inside the liner.

An air and water-tight lining assembly 200 is also useful for transporting moisture sensitive commodities such as plastics, flour and sugar. When the lining assembly is used to carry such commodities, it may be preferred to develop an inert atmosphere inside the assembly. This may be done by removing oxygen, which normally accelerates or exacerbates the affect moisture has on such products, and then injecting an inert gas, such as nitrogen, into liner 202.

Some bulk commodities produce gases while stored or carried in cargo containers; and an alternate embodiment of system 200 may be constructed and used so that gases produced by a commodity inside the lining system pass outward from the lining system. For instance, chutes 214 and 216 may be made of a fabric that is gas permeable in both directions—that is, gas is able to permeate through the chutes both outward from the interior of the liner, and inward into that interior from outside the liner—or the chutes 214 and 216 may be made from a material that is gas permeable only in the outward direction—that is, gas is able to permeate outward through the chutes from the interior of liner 200, but not inward through the chutes from outside the liner.

Alternatively, liner 202 itself may be made of a material that is gas permeable, either outward only or both inward and outward. For example, plastic films are known that will allow gases to escape through the microscopic pores in in the films, even though the films are waterproof, and liner 202 may be made from one of such films. Another way to allow gas to pass outward from the interior of liner 202 is by loosely closing chutes 214 and 216 so that gas is able to pass outward through those chutes. With this procedure, the chutes may be made from an airtight material, although they may, of course, be made from other types of materials.

A lining system 200 that allows gas to pass outward may be used in a number of different ways. For example, again with reference to FIG. 15, with one procedure, prior to being loaded with the commodity, liner 202 is inflated with air, nitrogen or another suitable gas; and, after the desired weight of the commodity is put into the liner, a low pressure, or vacuum, line is connected to the liner inlet and gas is withdrawn from inside the liner. Liner 202 collapses onto the commodity in the liner, eliminating the space between the top of the commodity and the top of the liner, and either developing or adding space between the top of the liner and the top of cargo container 224.

Gas produced by the commodity during transportation or storage passes outward through liner 202 and into space 226 between the top of the liner and container 224. Typically, a cargo container has small cracks or spaces in or between the walls of the container or between the walls and roof of the container, and thus gases which pass into space 226 naturally progress outward through the cracks and spaces in the walls and ceiling of container 224. If desired, cargo container 224 may be provided with special openings or vents to discharge gases that collect inside the container.

Figure 16:
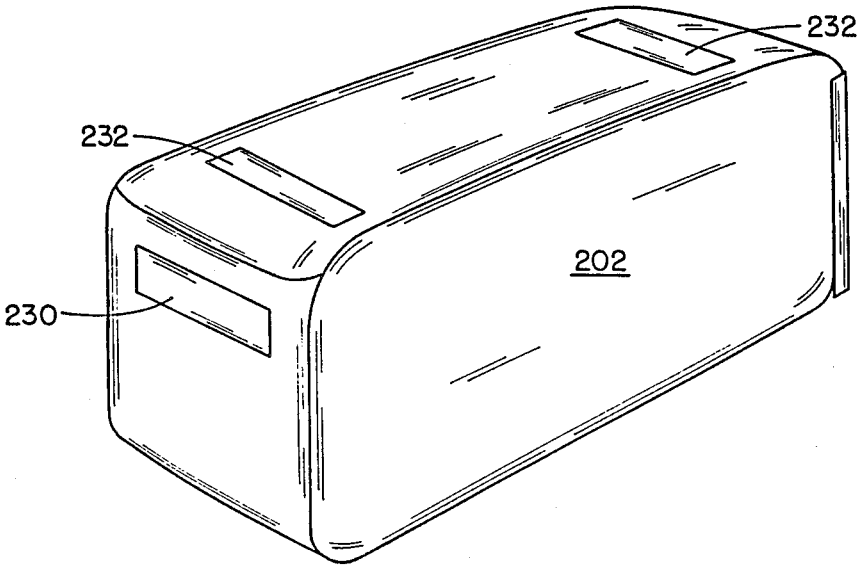
FIG. 16 is a back perspective of an alternate liner that may be used in the lining system illustrated in FIG. 12.

It is not necessary that liner 202 be provided with a plurality of openings to achieve the desired venting of gases produced by commodities inside the liner, and this venting can be achieved with just one opening in liner 202. Also, the vent opening or openings in liner 202 may be located in various places in the liner. For instance, with reference to FIG. 16, liner 202 may be provided with one opening 230 in the back end of the liner, a pair of openings 232 in the top of the liner, and a fourth opening (not shown) in the front end of the liner. Each of these openings may be provided with a separate cover, and the cover for the back opening may also be used to form a chute, analogous to chutes 214 and 216 discussed above, to help load and unload cargo from the liner. The openings in liner 202 may have a variety of sizes, dimensions and shapes, and the covers for these openings may be made from a variety of materials.

The openings in liner 200 also help to inspect the cargo therein, either to check the condition of that cargo or to check for contraband or other illegal goods that may be hidden inside the sleeve. Such an inspection may be made by simply inserting a probe through a liner opening and into the cargo therein, either to probe for hidden objects or to withdraw a sample of the cargo, which may then be inspected or tested to show the condition of the cargo.

The lining systems of the present invention are very well-suited to carry coffee and cocoa beans, however these systems are not limited to being used with such commodities; and the lining systems may be used with other agricultural products as well as other moisture sensitive products such as computer parts, machine parts, other hardware, and paper products. Further, liners 202 may be made of any suitable material or materials, and an individual liner may be comprised of inside and outside layers made of different materials either permanently bonded or loosely held together.

Figure 17:
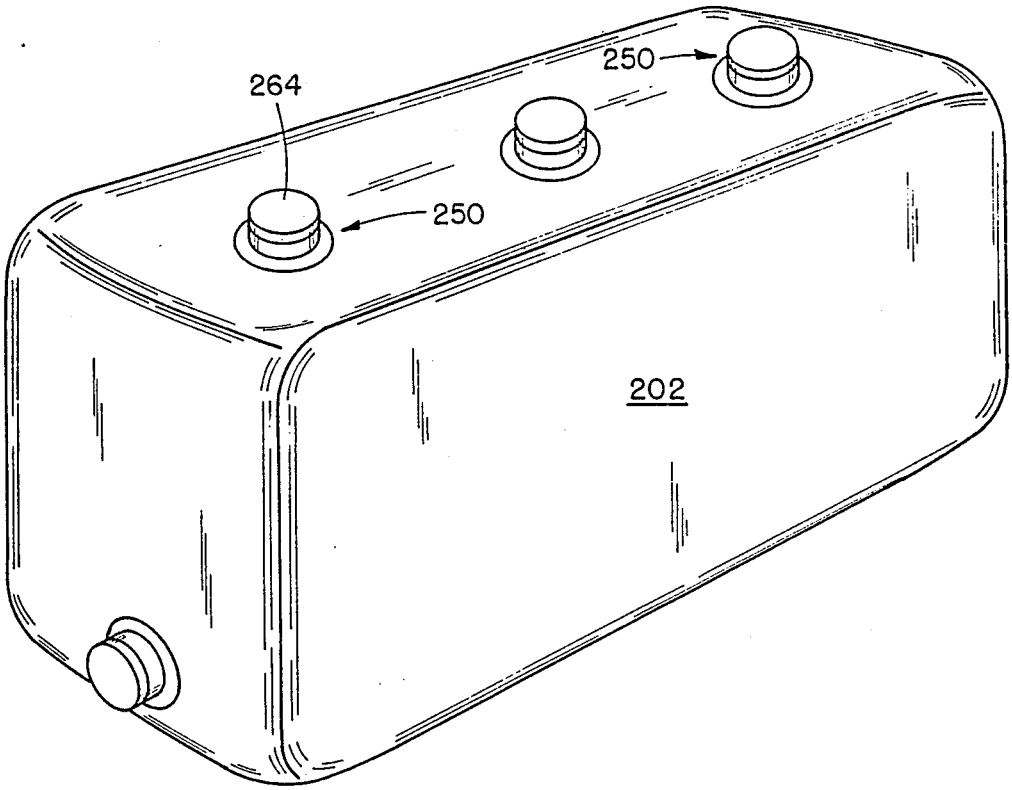
FIG. 17 is a back perspective view of another liner that may be used in the lining system of FIG. 12.
Figure 18:
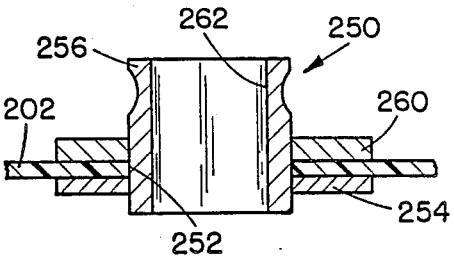
FIG. 18 is a side, cross-sectional view of a fitting used with the liner of FIG. 17.
Figure 19:
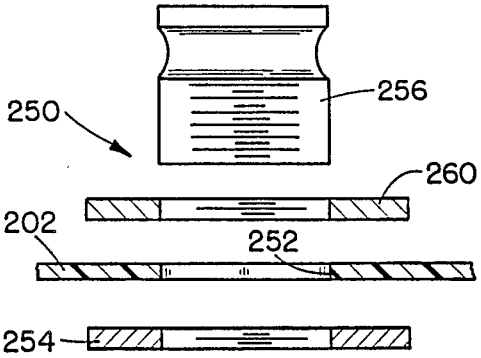
FIG. 19 is a side, exploded view, partially in cross-section, of the fitting shown in FIG. 18.

During operation of lining system 200, materials such as gases, liquids and solids may be conducted into and out of the interior of liner 202; and, this is done by connecting conduit means such as a tube, line or hose to the liner, and then conducting the materials through the conduit means, either into or out from the liner. As shown in FIG. 17, liner 202 may be provided with one or more fittings 250 to help connect the liner to such conduit means. FIGS. 18 and 19 show in greater detail a fitting 250 that is connected to liner 202 around opening 252; and generally the fitting comprises inside flange 254, coupling member 256 and outside flange 260. Inside flange 254 is located inside liner 202 and is held against an inside surface thereof. Coupling member 256 extends through opening 252 in liner 202, and has an inside portion connected to inside flange 252 and an outside portion located outside the liner, and the coupling member defines a conduit 262 extending through the opening in the liner to conduct material into and out of the interior of the liner. Outside flange 260 is mounted on the outside portion of coupling member 256, is held against an outside surface of liner 202, and tightly clamps the liner between the inside and outside flanges of the fitting, securely holding the entire fitting 250 in place on the liner.

The coupling member 256 may be connected to inside and outside flanges 254 and 260 in any suitable way, although preferably those flanges are threaded onto the coupling member. More specifically, coupling member 256 has a generally tubular shape, including an outside threaded surface, and inside and outside flanges 254 and 260 are threaded onto this outside surface of the coupling member. The outside portion of coupling member 256 is adapted to be connected to a hose or line (not shown), and, for example, the hose or line may be threaded onto the outside portion of the coupling member. Many suitable connecting arrangements are very well-known in the art, and it is unnecessary to explain such arrangements in detail herein.

Liner 202 is principally intended to line a cargo container, and the walls or ceilings of the container may be provided with ports or openings to provide access to openings 252 in the liner. If this is the case, it is desirable to locate liner 202 in the cargo container with fittings 250 located in, immediately below or next to openings in the cargo container; and it may further be preferred to provide fittings 250 with means to connect the fittings to the cargo container, to thereby hold the fitting in place therein.

Figure 20:
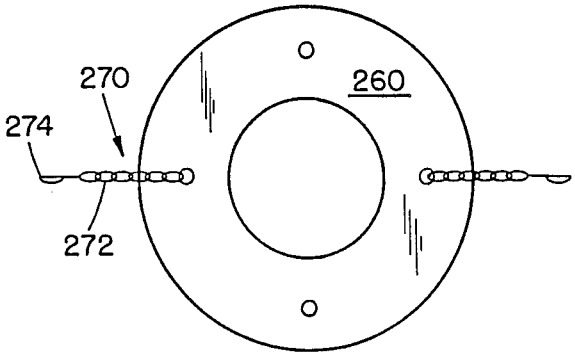

As will be understood by those of ordinary skill in the art, numerous specific arrangements may be employed to connect fitting 250 to a cargo container; and, as shown in FIG. 20, this connecting means 270 may include a plurality of chains 272 and hooks 274. A first end of each chain 272 is connected to outside flange 260 of fitting 250, and a second end of each chain is connected to a hook 274 that is adapted to engage a hook, eyebolt or similar projection connected to a wall or ceiling of the cargo container. During normal use of liner 202, a cap or cover 264, shown in FIG. 17, is mounted on fitting 250 to close the top of coupling member 256 and to prevent air, water or cargo from inadvertently passing into or out of the liner via opening 252. The cap is removed to conduct material through liner opening 252.

Figure 21:
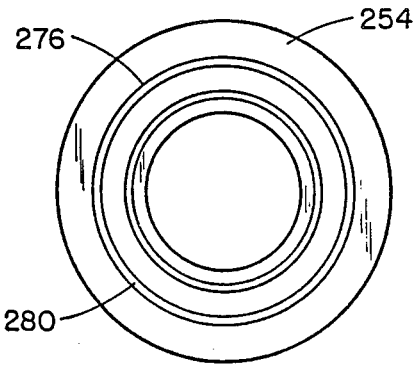
FIGS. 20 and 21 are top views of lower and upper flanges, respectively, of the fitting.

With reference to FIG. 21, to insure an air and watertight connection between liner 202 and fitting 250, at least one of the inside and outside flanges 254 and 260 includes a groove 276 that, in use, faces the liner and forms a closed path projecting around liner opening 252; and a seal 280 is seated in this groove and, in use, is tightly held against the liner, inhibiting, and ideally preventing, air and water from passing into or out of the interior of the liner through the interfaces between flanges 254 and 260 and liner 202.

Figure 22:
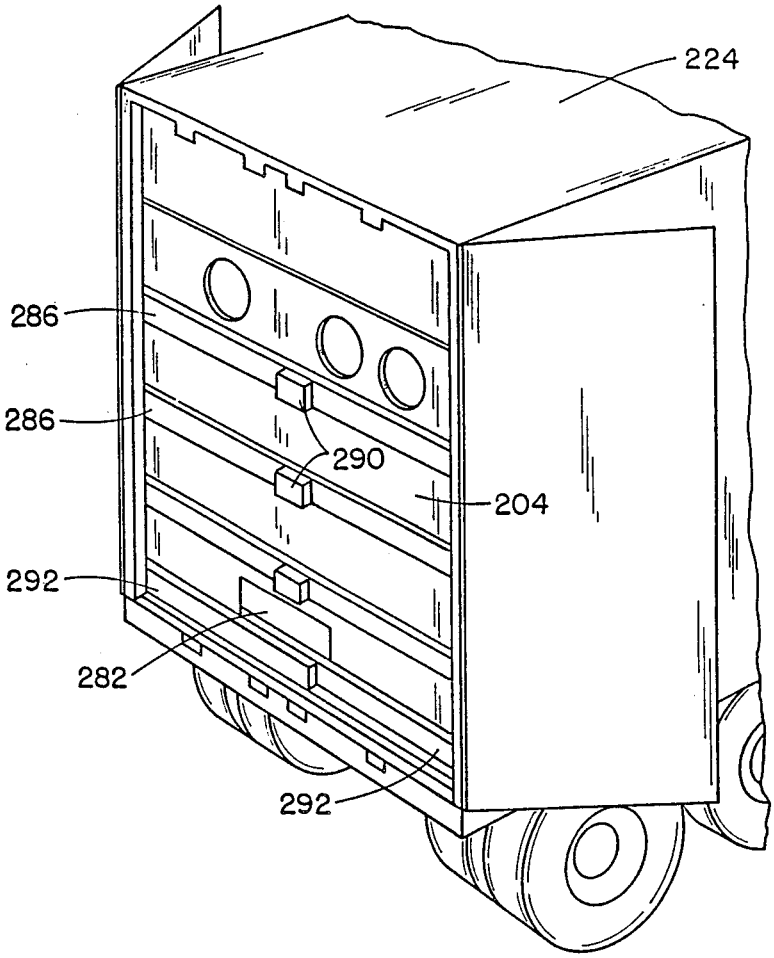
FIG. 22 is a back perspective view showing the bulkhead of this invention installed in a cargo container.
Figure 23:
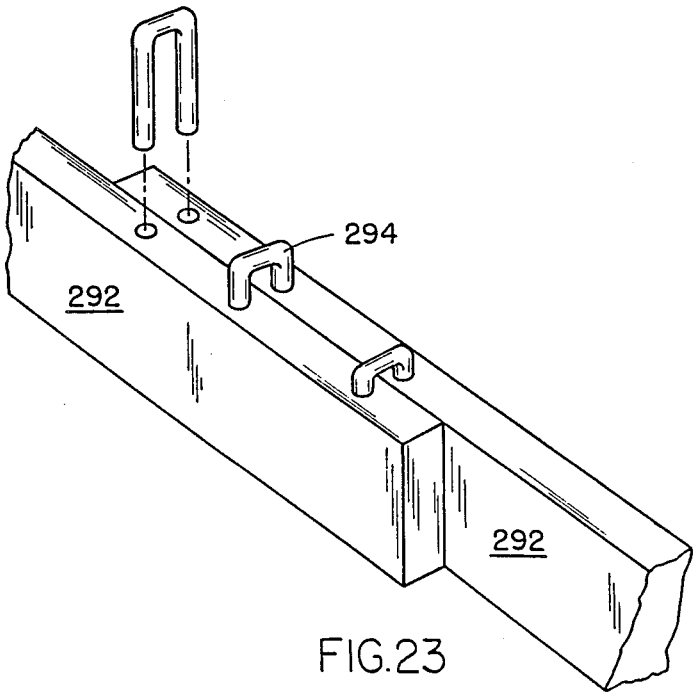
FIG. 23 shows a pair of boards used to reinforce the bulkhead in the container illustrated in FIG. 22.

With reference to FIGS. 12, 22 and 23, it may be preferred to cover discharge opening 222 of bulkhead 204 during the transportation of container 224 to prevent liner 202 from bulging outwardly through that discharge opening, and bulkhead 204 itself may be braced during transportation of the container to prevent the bulkhead from bulging outwardly.

Discharge opening 222 may be covered in any acceptable way; and, for example, the discharge opening may be formed by cutting out a portion of bulkhead 204, and then placing this cut-out portion 282 back into discharge opening 222 to cover that opening during transportation of container 224. Cover 282 for discharge opening 222 may be held in place in any suitable way. For example, a strip of fabric (not shown) may be glued to cover 282, extending around and over the periphery thereof, and this fabric may then be glued to bulkhead 204 around discharge opening 222 to hold the cover in place. When it is desired to unload the cargo from container 224, this fabric may be cut around the periphery of cover 282 to separate that cover from bulkhead 204 and to allow the cover to be removed from discharge outlet 222. Cover 282 may be provided with a handle (not shown) to assist placing the cover in and removing it from discharge opening 222.

Also, bulkhead 204 may be braced in a variety of ways; and, for instance, as shown in FIG. 22, a plurality of boards 286 extend behind and across the bulkhead, and ends of these boards are connected to corner posts on container 224 to hold the boards 286 themselves in place. Spacing blocks 290 are mounted on boards 286 to abut against the rear wall or doors of container 224 during normal transportation thereof and to prevent outward bowing of the bracing boards. A pair of boards 292 are used to brace the lower portion of bulkhead 204 and cover 282, and these boards are releasably connected together, for instance by a plurality of u-shaped pins 294 as shown in FIG. 23. With this arrangement, it is very easy to remove boards 292 to provide access to bulkhead discharge opening 222 while keeping boards 286 in place.

While it is apparent that the invention disclosed herein is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

What is claimed is:

1. A moveable bulkhead, comprising:

a rectangular, generally vertical and moveable wall member including (i) a lower portion (ii) an outlet opening in the lower portion to conduct a cargo through the bulkhead, and (iii) a bottom edge and first and second side edges, the bottom and first side edges forming a first lower corner, and the bottom and second side edges forming a second lower corner; and a first corner member connected to the wall member adjacent to the first lower corner and along a connecting line extending upward away from the outlet opening and toward the first side edge;

the first corner member being connected to the wall member for movement between open and closed positions, and wherein (i) in the closed position, the first corner member is adjacent the wall member, and (ii) in the open position, the first corner member slants outwardly downwardly away from the wall member, and laterally inwardly downwardly away from the first side edge and toward the outlet, to guide the cargo downwardly and laterally inwardly.

2. A bulkhead according to claim 1, further comprising retaining means connected to the wall member for movement between a closed position, wherein the retaining means hold the first corner member in its closed position, and an open position, wherein the retaining means allows the first corner member to move between its open and closed positions.

3. A bulkhead according to claim 2, wherein:

the wall member has front and back sides;

the first corner member is connected to the front side of the wall member; and the bulkhead further comprises a first strap connected to the first corner member and extending through the wall member, to facilitate shaking the first corner member from the back side of the wall member.

4. A bulkhead according to claim 1, wherein the first corner member is connected to the wall member for pivotal movement about said connecting line.

5. A bulkhead according to claim 4, wherein the first corner member has a generally flat shape.

6. A bulkhead according to claim 5, wherein in the closed position, the corner member is generally parallel to the wall member.

7. A bulkhead according to claim 1, further comprising pulling means to pull the first corner member from the closed position to the open position.

8. A bulkhead according to claim 7, wherein:

the wall member has front and back sides;

the first corner member is connected to the front side of the wall member; and the wall member further includes an access opening to provide access to the pulling means from the back side of the wall member.

9. A bulkhead according to claim 8, wherein:

the first corner member is connected to the wall member for pivotal movement about said connecting line, between the open and closed positions; and the access opening is located between the first lower corner and the connecting line.

10. A bulkhead according to claim 9, further comprising means to further connect the first corner member to the wall member to releasably hold the first corner member in the open position.

11. A bulkhead according to claim 10, wherein:

the access opening includes an edge; and the means to further connect the first corner member to the wall member includes means connected to the pulling means to connect the pulling means releasably to the edge of the access opening.

12. A moveable bulkhead, comprising:

a rectangular, generally vertical and moveable wall member including (i) a lower portion, (ii) an outlet opening in the lower portion to conduct a cargo through the bulkhead, and (iii) a bottom edge and first and second side edges, the bottom and first side edges forming a first lower corner, and the bottom and second side edges forming a second lower corner;

a first corner member connected to the wall member adjacent to the first lower corner and along a first connecting line extending upward away from the outlet opening and toward the first side edge, the first corner member being connected to the wall member for movement between open and closed positions, and wherein (i) in the closed position, the first corner member is adjacent the wall member, and (ii) in the open position, the first corner member slants outwardly downwardly away from the wall member, and laterally inwardly downwardly away from the first side edge and toward the outlet, to guide the cargo downwardly and laterally inwardly; and a second corner member connected to the wall member adjacent to the second lower corner and along a second connecting line extending upward away from the outlet opening and toward the second side edge, the second corner member being connected to the wall member for movement between open and closed positions, and wherein (i) in its closed position, the second corner member is adjacent the wall member, and (ii) in its open position, the second corner member slants outwardly downwardly away from the wall member, and laterally inwardly downwardly away from the second side edge and toward the outlet, to guide the cargo downwardly and laterally inwardly.

13. A bulkhead according to claim 12, wherein:

the first corner member is pivotally connected to the wall member along said first connecting line; and the second corner member is pivotally connected to the wall member along the second connecting line.

14. A bulkhead according to claim 13, wherein:

the first corner member has a generally flat shape; and the second corner member has a generally flat shape.

15. A bulkhead according to claim 14, wherein:

in its closed position, the first corner member is generally parallel to the wall member; and in its closed position, the second corner member is generally parallel to the wall member.

* * * * *